US009242844B2

(12) United States Patent
Liu

(10) Patent No.: US 9,242,844 B2
(45) Date of Patent: Jan. 26, 2016

(54) FUNNEL FOR A WATER TANK

(71) Applicant: COSDA MANU FACTURING COMPANY, Taichung (TW)

(72) Inventor: Lai-Cheng Liu, Taichung (TW)

(73) Assignee: COSDA MANU FACTURING COMPANY, Taichung (TW)

( * ) Notice: Subject to any disclaimer, the term of this patent is extended or adjusted under 35 U.S.C. 154(b) by 0 days.

(21) Appl. No.: 14/275,844

(22) Filed: May 12, 2014

(65) Prior Publication Data

US 2015/0321892 A1 Nov. 12, 2015

(51) Int. Cl.
*B67C 11/06* (2006.01)
*B67C 11/00* (2006.01)

(52) U.S. Cl.
CPC ..... *B67C 11/063* (2013.01); *B67C 2011/30* (2013.01)

(58) Field of Classification Search
CPC ..... B67C 11/00; B67C 11/04; B67C 11/06; B67C 11/063; B67D 7/005
USPC ..... 141/297, 331–345, 351, 356, 363–366, 141/292; 222/525
See application file for complete search history.

(56) References Cited

U.S. PATENT DOCUMENTS

| | | | | | |
|---|---|---|---|---|---|
| 64,752 | A * | 5/1867 | Dickenson | 141/335 |
| 530,690 | A * | 12/1894 | James | 141/335 |
| 2,593,634 | A * | 4/1952 | Vosburg | 222/514 |
| 2,868,246 | A * | 1/1959 | Nelson | 141/286 |
| 3,543,814 | A * | 12/1970 | Alutto | 141/335 |
| 5,560,522 | A * | 10/1996 | Clark | 222/481.5 |
| 9,038,677 | B2 * | 5/2015 | Keefe | 141/109 |

* cited by examiner

*Primary Examiner* — Timothy L Maust
*Assistant Examiner* — Timothy P Kelly

(57) ABSTRACT

A funnel for a water tank is for adapting to a water injection portion. The water injection portion is communicated with the water tank. The funnel includes a container body and a valve assembly. The container body has an inner wall, an abutting portion, an internal space, and an injection opening and an output opening which are communicated with the internal space. The valve assembly is abuttable against the abutting portion. The valve assembly includes an actuating member communicated with the output opening and a valve body which is coupled with the actuating member. When the actuating member is located in a first position, the container body is uncommunicated with the interior of the water tank. When the actuating member is away from the first position, the container body is communicated with the water tank to allow liquid flow into the water tank.

7 Claims, 7 Drawing Sheets

FUNNEL FOR A WATER TANK

BACKGROUND OF THE INVENTION

1. Field of the Invention

The present invention relates to a funnel, and more particularly to a funnel for a water tank.

2. Description of the Prior Art

A water tank is a very important part of a cooling system for an engine on a car. The water has a large specific heat so that the temperature of the water increases little after the water absorbs heat of the engine, and it prevents the engine from overheating. And the heat of the engine conducts to the water through a liquid loop of the water. It is ordinary to add chemical compounds with ethers into the water tank to increase the heat dissipation efficiency for the water and decrease the risk that the water tank gets rust. The heat is dissipated by passing through a heat dissipation plate with a large surface area and use of air convection so that the temperature of the engine decreases and remains at a workable temperature for the engine. After a period of using, the water (including chemical compounds with ethers) in the water tank gets acidified and corrodes the water tank and the liquid loop so that the water in the water tank must be replaced regularly. And it is easier to use a funnel to add the water into the water tank.

However, a funnel of a prior art is unequipped with a structure for stopping adding water. If the water in the water tank is filled and the funnel still has the water, and when moving away the funnel from the water tank, the water in the funnel flows out from the bottom of the funnel. When the water drops on ground, it needs to be cleaned because the water contains chemical compounds and it pollutes an environment. And the water with chemical compounds can also injure human skin. Furthermore, when the water tank is about to be filled, the engine needs to be started to heat itself and drive a water pump so that the water cycles in the cooling system. And it helps to remove air in the water tank and the liquid loop. Besides, it is normal that an oversized hot bubble comes out from the water tank through the funnel and causes people to hurt. This disadvantage is needed to be improved.

The present invention has arisen to mitigate and/or obviate the afore-described disadvantages.

SUMMARY OF THE INVENTION

The primary object of the present invention is to provide a funnel for a water tank. The funnel comprises a valve body structure. If the water tank is about to be filled when adding water into the water tank and the funnel still has the water, the water in the funnel is forbidden to flow out when moving away the funnel from the water tank.

Furthermore, the valve body structure of the funnel buffers and slows a bubble coming out from the water tank through the funnel. And it avoids that the bubble comes out with a fast speed and sprays hot water to injure people.

To achieve the above object, a funnel for a water tank for adapting to a water injection portion is provided. The water injection portion is communicated with the interior of the water tank. The funnel includes a container body and a valve assembly. The container body has an inner wall, an abutting portion provided on the inner wall, an internal space defined by the inner wall, and an injection opening and an output opening which are communicated with the internal space. The valve assembly is able to abut against the abutting portion and located within the container body. The valve assembly includes an actuating member which is communicated with the output opening and a valve body which is coupled with the actuating member. When the actuating member is located in a first position, the container body is uncommunicated with the interior of the water tank. When the actuating member is away from the first position, the container body is communicated with the water tank to allow liquid to flow into the water tank.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
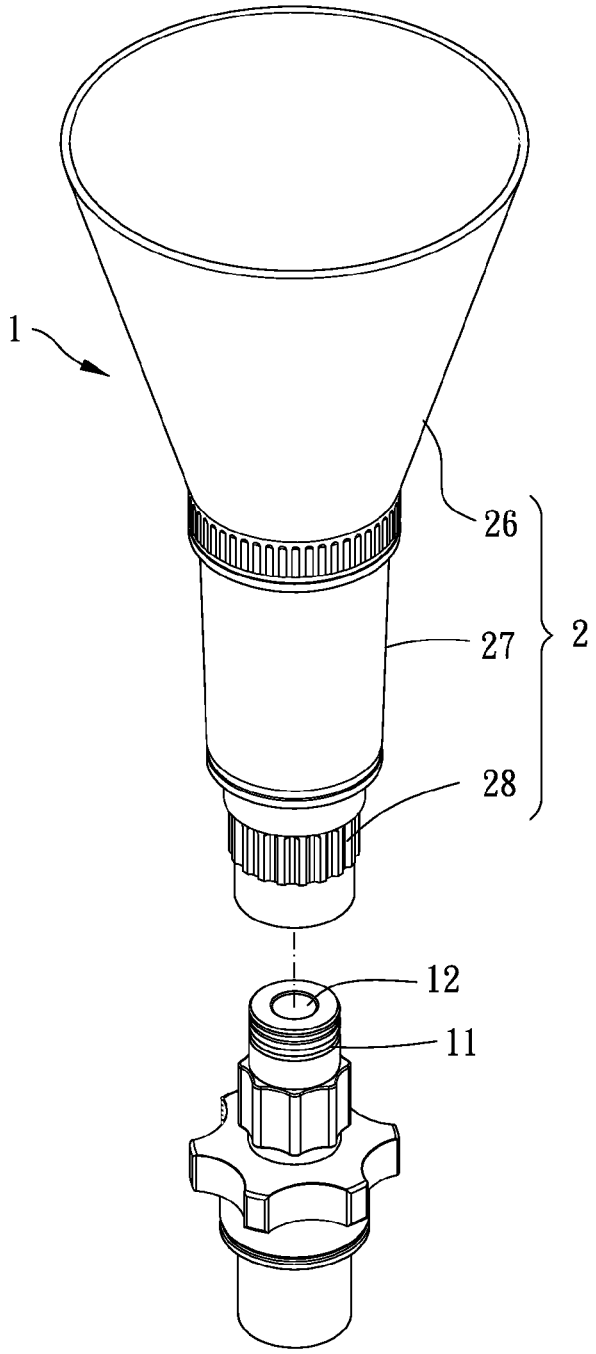
FIG. 1 is a three-dimensional drawing of a funnel in accordance with a first embodiment of the present invention.
Figure 2:
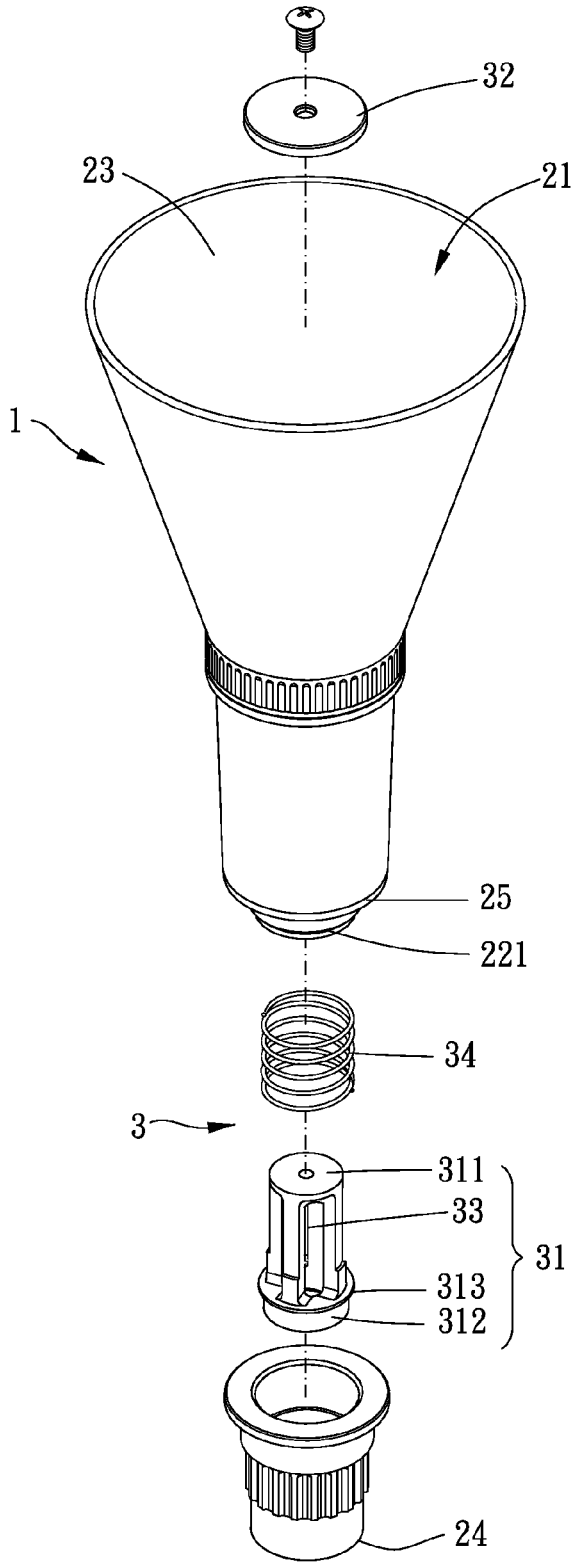
FIG. 2 is a breakdown drawing of the funnel in accordance with the first embodiment of the present invention.
Figure 3:
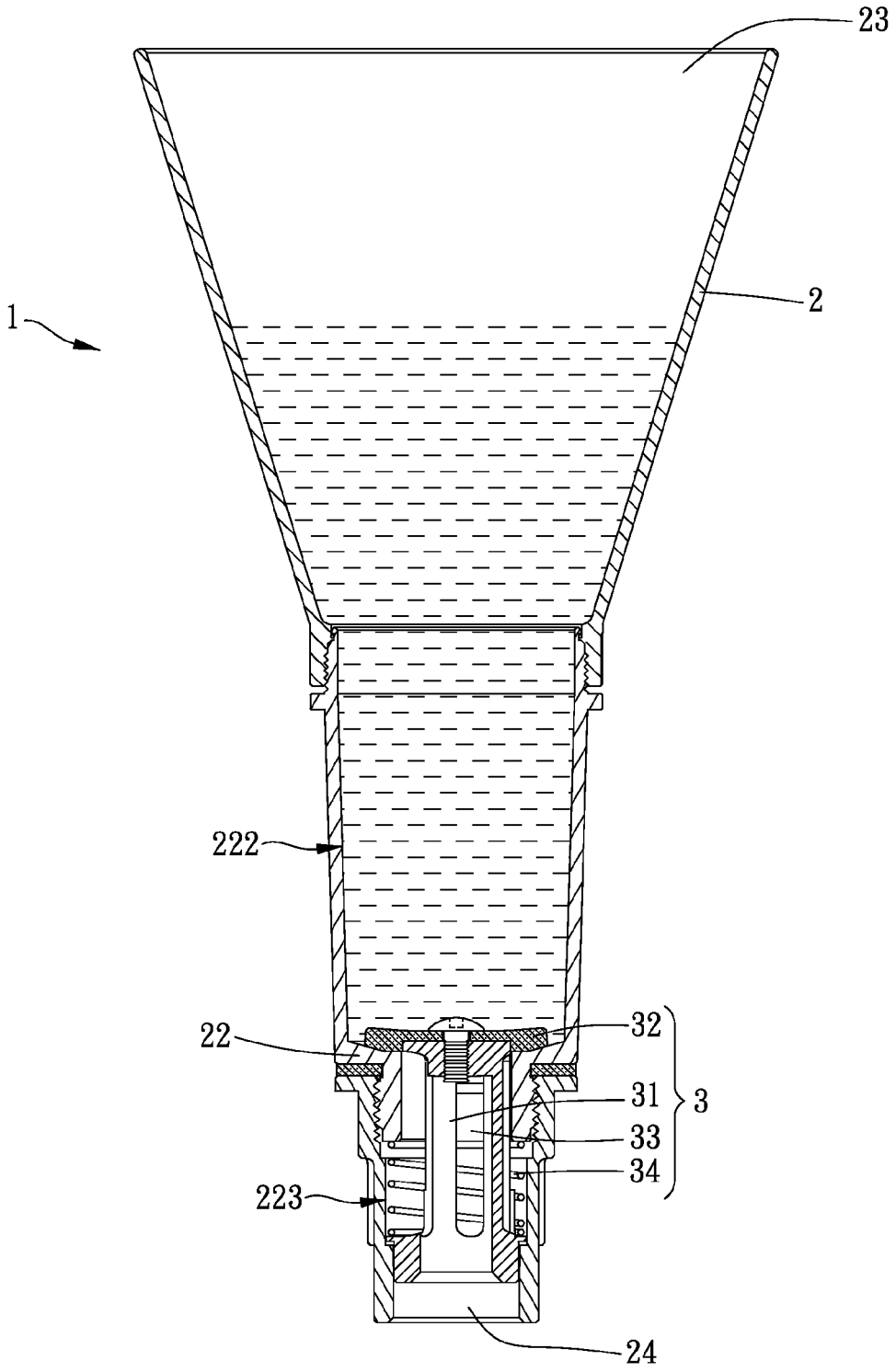
FIG. 3 is a cross-sectional drawing of the funnel in accordance with the first embodiment of the present invention.

Referring to FIGS. 1-3, it shows a funnel in accordance with a first embodiment of the present invention. The funnel 1 is for adapting to a water injection portion 11 of a water tank (not shown in Figs.). The water injection portion 11 includes a first channel 12 communicated with the interior and the exterior of the water tank. The funnel 1 includes a container body 2 and a valve assembly 3.

The container body 2 includes an inner wall 21, an abutting portion 22 provided on the inner wall 21, an internal space defined by the inner wall, and an injection opening 23 and an output opening 24 which are communicated with the internal space. The abutting portion 22 defines a throat port 221. Wherein based on the abutting portion 22 the internal space is defined as an upper space 222 and a bottom space 223. It is noted that, the container body 2 further includes a perspective portion 224, and the perspective portion 224 is made of a perspective material and corresponds to the upper space 222. The perspective material can be full transparent, half transparent or foggy so that the interior of the container body is observed from outside through the perspective material. It is unnecessary for an operator to look at the injection opening 23, and the operator still sees the bubble floating from the water tank to the container body 2 and knows if the water tank is filled or not. This design effectively prevents that the water sprays out and injuries people. The inner wall 21 of the container body 2 is formed with a stepped portion 25 in the bottom space 223.

The container body 2 includes a flared portion 26, a middle portion 27 and a head portion 28. The middle portion 27 is detachably assembled between the flared portion 26 and the head portion 28. The injection opening 23 is disposed on the flared portion 26. The abutting portion 22 is disposed on the middle portion 27, and the output opening 24 is disposed on the head portion 28. This design is convenient for detaching and storage after using the funnel 1.

The valve assembly 3 is abuttable against the abutting portion 22 and located within the container body 2. The valve assembly 3 includes an actuating member 31 and a valve body 32 coupled with a first end 311 of the actuating member 31. The actuating member 31 defines an axial direction. Preferably, in the present embodiment, a second end 312 of the actuating member 31 is unprotrusive out from the output opening 24. In other embodiments, the second end 312 of the actuating member 31 is able to be protrusive out from the output opening 24. The actuating member 31 includes at least one second channel communicated with the output opening 24. The actuating member 31 is movable relative to the container body 2 between a first position and a second position. Practically, the actuating member 31 is formed with a radial flange 313 at the second end 312. An elastic member 34 is disposed between the radial flange 313 and the container body 2. The elastic member 34 is disposed between the radial flange 313 and the stepped portion 25 to urge the valve body 32 to move towards the first position. The actuating member 31 is actuatable to move towards the second position by the water injection portion 11 inserting in the container body 2. The valve body 32 is a circular plate member. The throat port 221 is disposed between the valve body 32 and the actuating member 31. Relative to the axial direction the valve body 32 is greater than the throat port 221 in radial dimension.

Moreover, when the actuating member 31 is located in the first position, because the radial dimension of the valve body 32 is greater than that of the throat port 221 so that the valve body 32 liquid-tightly abuts against the abutting portion 22 and the second channel 33 of the actuating member 31 is fluidly uncommunicated with the upper space 222. The liquid in the upper space 222 is unable to flow out through the output opening 24. When the actuating member 31 moves away from the first position, the valve body 32 is disengaged from the abutting portion 22 and the second channel 33 is communicated with the upper space 222 and the bottom space 223.

Figure 4:
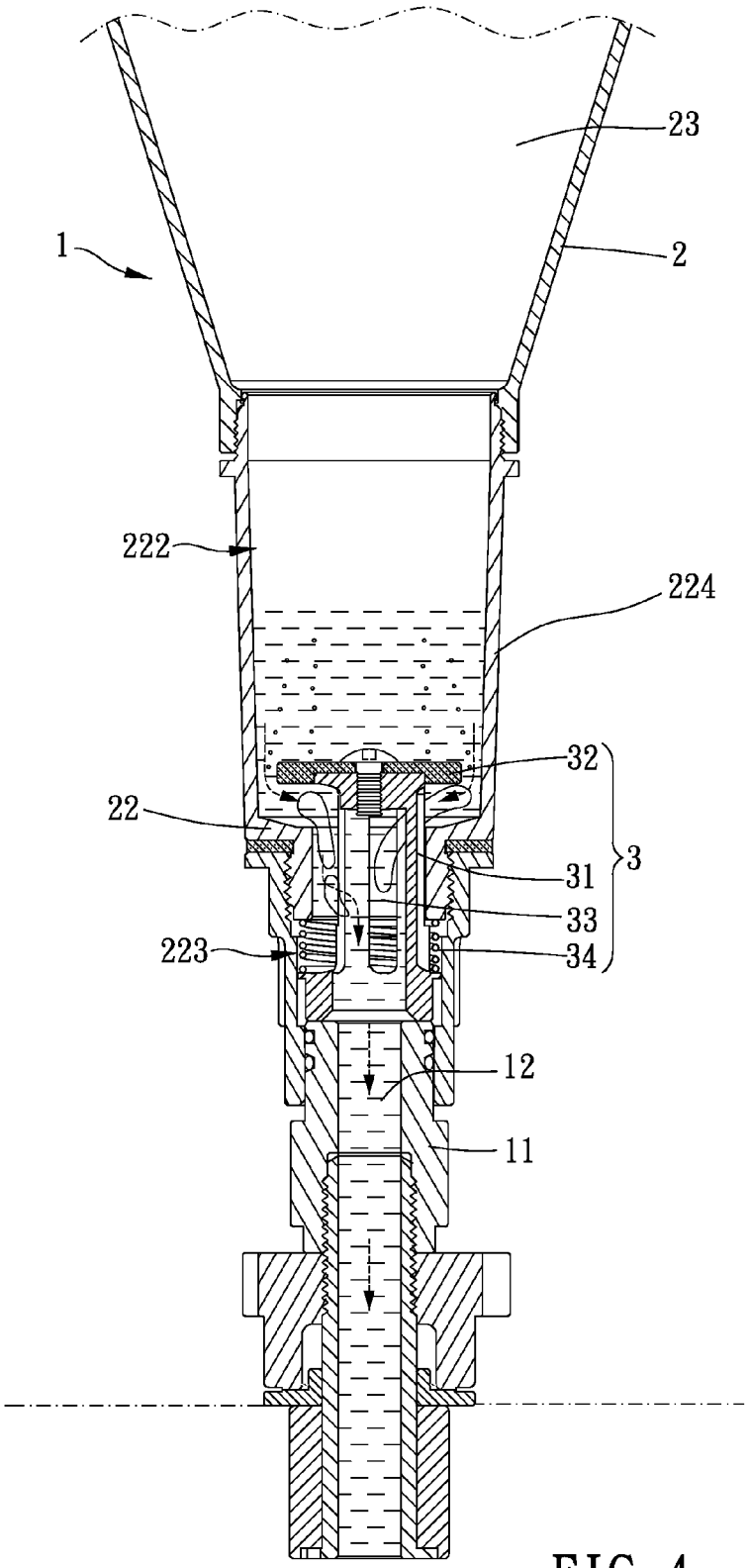
FIG. 4 is another cross-sectional drawing of the funnel in accordance with the first embodiment of the present invention.

Please refer to FIG. 4, when using the funnel 1, the water injection portion 11 is inserted in the container body 2. The water injection portion 11 abuts against the actuating member 31 to move away from the first position and towards the second position. The liquid is added to the upper space 222 via the injection opening 23. Because the valve body 32 is disengaged from the abutting portion 22, the liquid flows to the bottom space 223 through the second channel 33 (indicated by arrows as shown in FIG. 4). The liquid flows into the first channel 12 of the water injection portion 11 through the output opening and then flows into the water tank. Wherein if a bubble is oversized and floats with a high speed, the valve body 32 is able to buffer and slow the bubble and urge the bubble to divide into a plurality of small bubbles. The numerous small bubbles float up to the surface of the liquid through the radial circumference of the valve body 32. And it is much safe when adding the water into the water tank.

After finishing adding the water, the funnel 1 is removed from the water injection portion 11. The elastic member 34 drives the actuating member 31 to move back to the first position and urge the valve body 32 to abut against the abutting portion 22 liquid-tightly. The liquid in the upper space 222 is forbidden to flow out through the output opening 24. It avoids that the liquid drops on a part of an engine and makes an electrical circuit short or drops on a ground and pollutes an environment.

Figure 5:
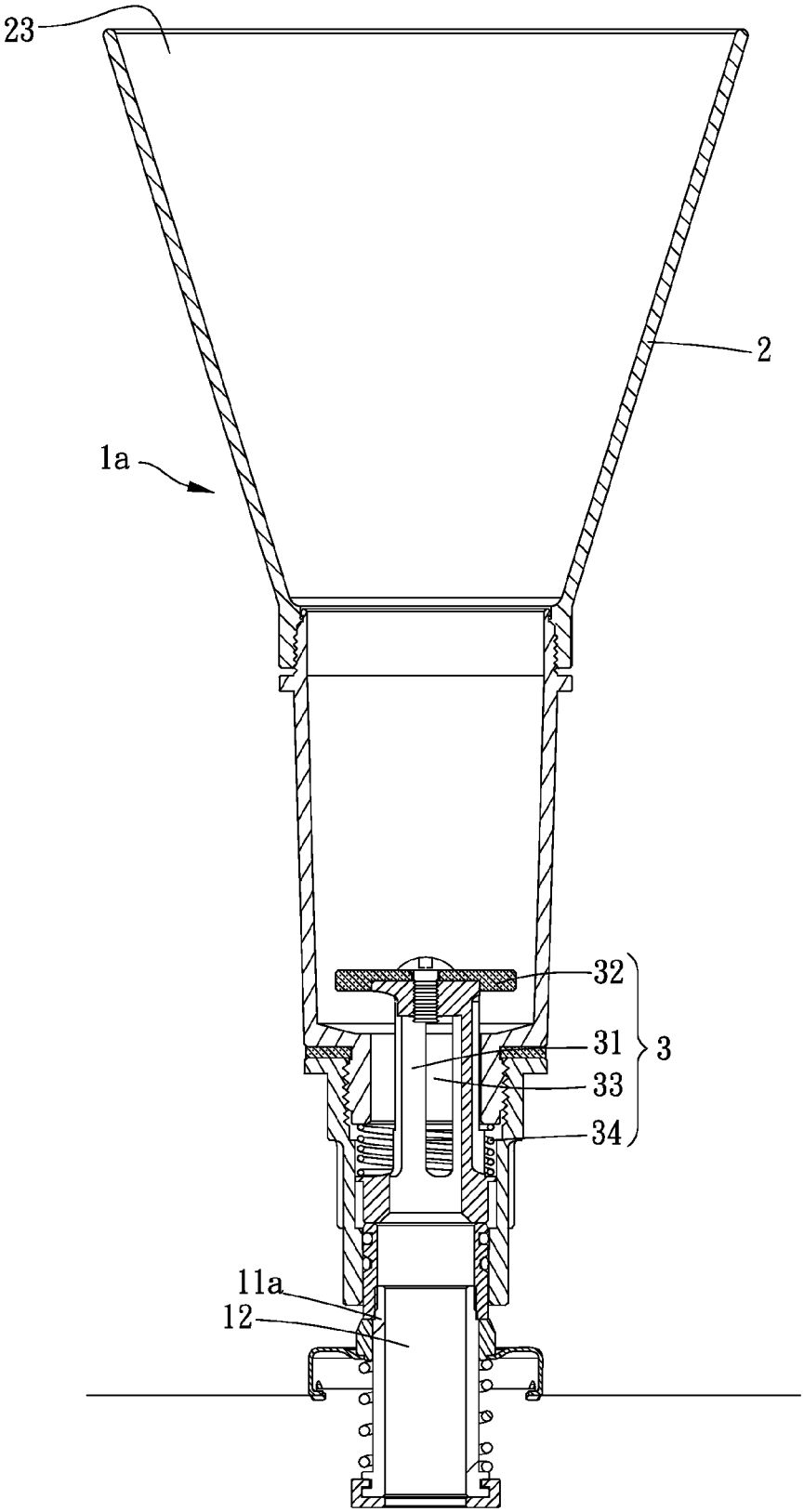
FIG. 5 is a cross-sectional drawing of the funnel in accordance with a second embodiment of the present invention.
Figure 5A:
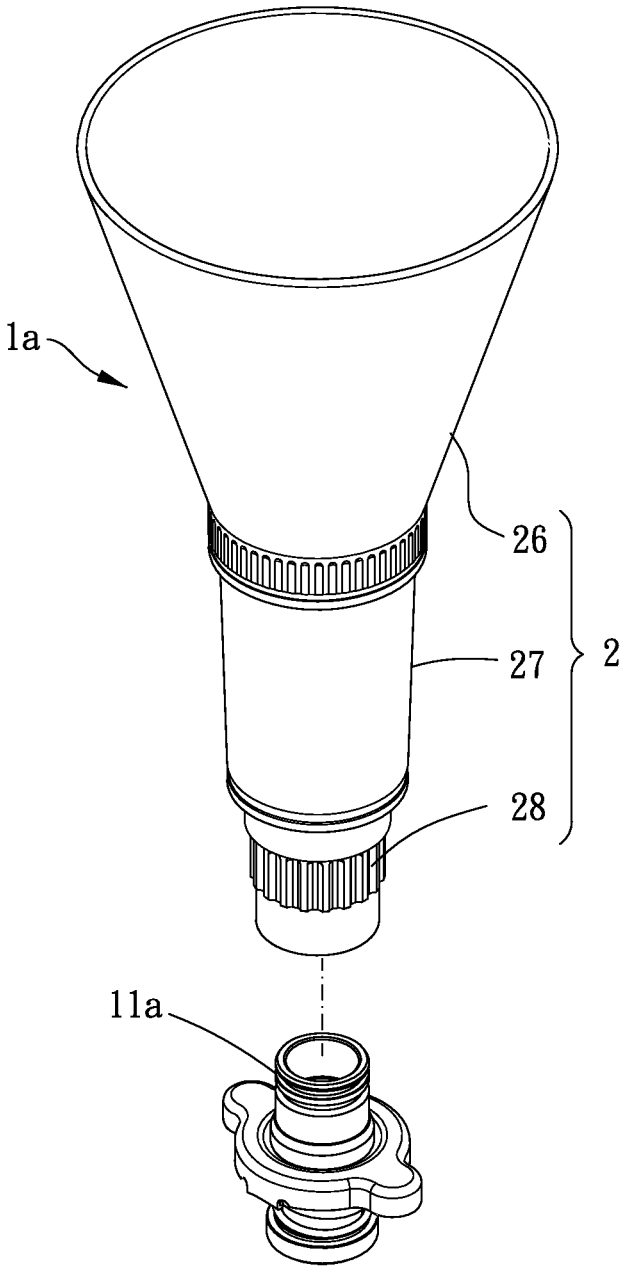
FIG. 5A is a partial cross-sectional drawing of the funnel in accordance with the second embodiment of the present invention.

Please refer to FIG. 5 and FIG. 5A, in the second embodiment of the present invention, the funnel 1*a* can be applied on a different water injection portion 11*a* with a different structure. And it is still available for the same target.

Figure 6:
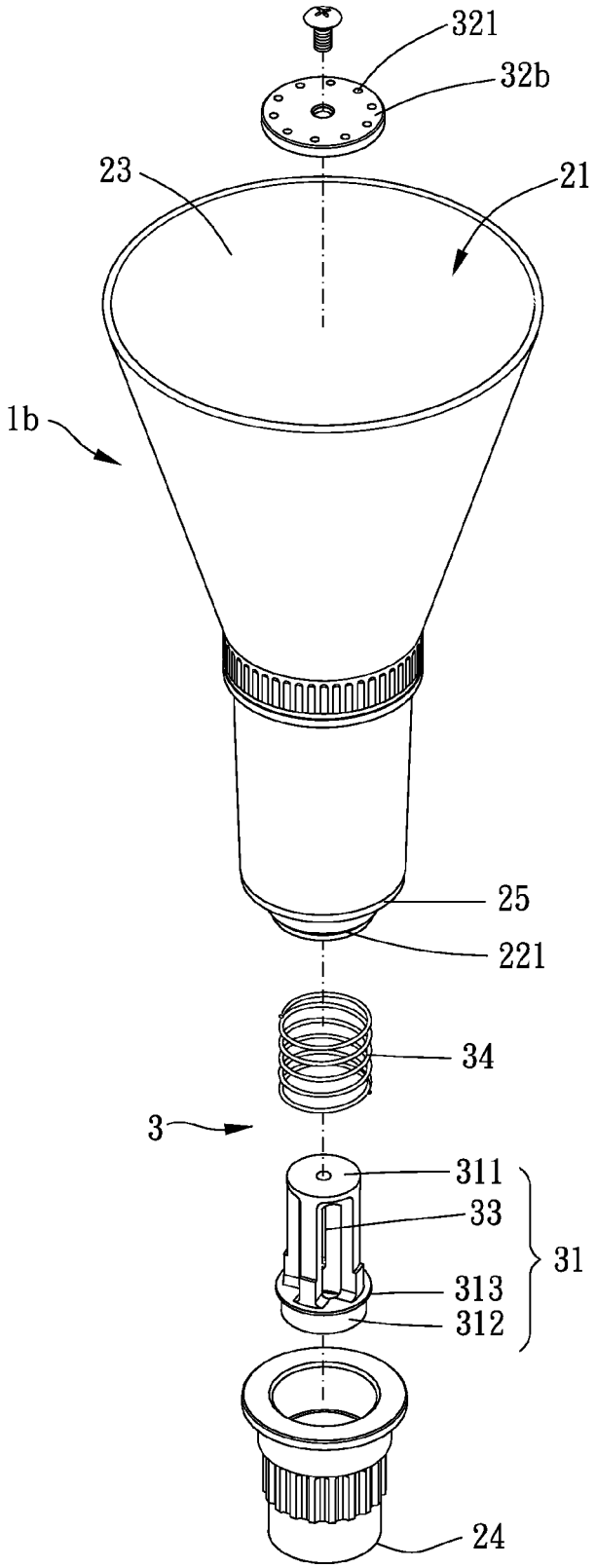
FIG. 6 is a partial breakdown drawing of the funnel in accordance with a third embodiment of the present invention.

Please refer to FIG. 6, compared to the above first embodiment, as viewed in the axial direction of the funnel 1*b* in the third embodiment, the valve body 32*b* is formed with a plurality of through holes 321 distributed outside a contour of the throat port 221. If the bubble is oversized, the through holes 321 make the oversized bubble to divide into numerous small bubbles and float up to the surface of the liquid. The bubbles are buffered by the valve body 32*b* and float up to the surface through the radial circumference of the valve body 32*b*. It is much safe when adding the water into the water tank.

As a conclusion, a funnel of the present invention includes a valve body structure. When adding water into a water tank, the water tank is filled and the funnel still has the water. The water is forbidden to flow out from the funnel when the funnel is removed from the water tank.

Besides, the valve body structure of the funnel can buffer and slow the bubbles floating from the water tank to the surface of the water to avoid that the bubbles float with a high speed and spray the water. And it is safe when adding the water into the water tank.

While we have shown and described various embodiments in accordance with the present invention, it should be clear to those skilled in the art that further embodiments may be made without departing from the scope of the present invention.

What is claimed is:

1. A funnel for a water tank, for adapting to a water injection portion, the water injection portion including a first channel communicated with the interior and the exterior of the water tank, the funnel comprising:

a container body, including an inner wall, an abutting portion provided on the inner wall, an internal space defined by the inner wall, and an injection opening and an output opening which are communicated with the internal space, wherein based on the abutting portion the internal space is defined as an upper space and a bottom space;

a valve assembly, abuttable against the abutting portion and located within the container body, the valve assembly including an actuating member and a valve body coupled with a first end of the actuating member, the actuating member including at least one second channel communicated with the output opening, the actuating member movable relative to the container body between a first position and a second position, the actuating member being actuatable to move towards the second position by the water injection portion inserting in the container body;

wherein when the actuating member is located in the first position, the valve body liquid-tightly abuts against the abutting portion, the second channel is fluidly uncommunicated with the upper space; when the actuating member moves away from the first position, the valve body is disengaged from the abutting portion and the second channel is communicated with the upper space and the bottom space;

wherein the actuating member defines an axial direction, the abutting portion defines a throat port, and relative to the axial direction the valve body is greater than the throat port in radial dimension;

wherein as viewed in the axial direction, the valve body is formed with a plurality of through holes distributed outside a contour of the throat port.

2. The funnel for a water tank as claimed in claim 1, wherein the actuating member is formed with a radial flange at a second end, and an elastic member is disposed between the radial flange and the container body to urge the valve body to move towards the first position.

3. The funnel for a water tank as claimed in claim 2, wherein the inner wall of the container body is formed with a stepped portion in the bottom space, and the elastic member is disposed between the radial flange and the stepped portion.

4. The funnel for a water tank as claimed in claim 1, wherein the valve body is a circular plate member.

5. The funnel for a water tank as claimed in claim 1, wherein the container body further including a perspective portion, and the perspective portion is made of a perspective material and corresponds to the upper space.

6. The funnel for a water tank as claimed in claim 1, wherein the container body includes a flared portion, a middle portion and a head portion, the middle portion is detachably assembled between the flared portion and the head portion, the flared portion is provided with the injection opening, the middle portion is provided with the abutting portion, and the head portion is provided with the output opening.

7. A funnel for a water tank, for adapting to a water injection portion, the water injection portion including a first channel communicated with the interior and the exterior of the water tank, the funnel comprising:

a container body, including an inner wall, an abutting portion provided on the inner wall, an internal space defined by the inner wall, and an injection opening and an output opening which are communicated with the internal space, wherein based on the abutting portion the internal space is defined as an upper space and a bottom space;

a valve assembly, abuttable against the abutting portion and located within the container body, the valve assembly including an actuating member and a valve body coupled with a first end of the actuating member, the actuating member including at least one second channel communicated with the output opening, the actuating member movable relative to the container body between a first position and a second position, the actuating member being actuatable to move towards the second position by the water injection portion inserting in the container body;

wherein when the actuating member is located in the first position, the valve body liquid-tightly abuts against the abutting portion, the second channel is fluidly uncommunicated with the upper space; when the actuating member moves away from the first position, the valve body is disengaged from the abutting portion and the second channel is communicated with the upper space and the bottom space;

wherein a second end of the actuating member is unprotrusive out from the output opening.

* * * * *